US012551774B2

(12) United States Patent
Rindlisbacher

(10) Patent No.: US 12,551,774 B2
(45) Date of Patent: Feb. 17, 2026

(54) SNOWLESS SUSPENSION SKI

(71) Applicant: Tanner Rindlisbacher, South Jordan, UT (US)

(72) Inventor: Tanner Rindlisbacher, South Jordan, UT (US)

(73) Assignee: Tanner Rindlisbacher

( * ) Notice: Subject to any disclaimer, the term of this patent is extended or adjusted under 35 U.S.C. 154(b) by 0 days.

(21) Appl. No.: 18/388,725

(22) Filed: Nov. 10, 2023

(65) Prior Publication Data

US 2024/0157224 A1 May 16, 2024

Related U.S. Application Data

(60) Provisional application No. 63/424,194, filed on Nov. 10, 2022.

(51) Int. Cl.
*A63C 17/00* (2006.01)

(52) U.S. Cl.
CPC ..... *A63C 17/0046* (2013.01)

(58) Field of Classification Search
CPC ..... A63C 17/0046; A63C 17/008; A63C 2203/20; A63C 2017/1472
See application file for complete search history.

(56) References Cited

U.S. PATENT DOCUMENTS

| | | | | | |
|---|---|---|---|---|---|
| 4,886,298 | A * | 12/1989 | Shols | A63C 17/045 | 280/842 |
| 5,931,480 | A * | 8/1999 | Schroeder | A63C 17/16 | 280/11.233 |
| 6,149,167 | A * | 11/2000 | Kao | A63C 17/0046 | 280/11.233 |
| 6,478,313 | B1 * | 11/2002 | Gray | A63C 17/0046 | 280/11.27 |
| 2004/0207165 | A1 * | 10/2004 | Wang | A63C 17/0046 | 280/11.225 |
| 2011/0175310 | A1 * | 7/2011 | Lewis | A63C 17/0046 | 280/87.042 |
| 2012/0126523 | A1 * | 5/2012 | Langer | A63C 17/045 | 280/842 |
| 2012/0261891 | A1 * | 10/2012 | Oliveira | A63C 17/0046 | 280/11.28 |
| 2014/0349818 | A1 * | 11/2014 | Green | A63C 17/065 | 482/77 |
| 2016/0175692 | A1 * | 6/2016 | Burns | A63C 17/262 | 280/842 |
| 2018/0028899 | A1 * | 2/2018 | Chen | A63C 17/008 | |
| 2018/0326293 | A1 * | 11/2018 | Wu | A63C 17/002 | |
| 2022/0387877 | A1 * | 12/2022 | DeGraff | A63C 17/0073 | |

* cited by examiner

*Primary Examiner* — Brian L Swenson
(74) *Attorney, Agent, or Firm* — Dax D. Anderson; Kirton McConkie

(57) ABSTRACT

A snowless suspension ski configured for downhill use on rough terrain, the ski having a pair of wheels connected to compression triangles that are rotatably secured to a frame, and having shock absorbers configured to compress when weight is applied to the ski, thereby allowing the ski to move between an extended configuration and a compressed configuration to absorb the shock experienced during a ride.

18 Claims, 9 Drawing Sheets

SNOWLESS SUSPENSION SKI

CROSS-REFERENCED APPLICATIONS

This application claims priority to U.S. Provisional Patent Application No. 63/424,194 which was filed Nov. 10, 2022.

BACKGROUND OF THE INVENTION

Field of the Invention

The present invention relates to general field of downhill skis, and more particularly to snowless roller skis.

Background and Related Art

Traditional skis function only when there is enough snow to provide a snowy surface to ski on. Accordingly, traditional skiing is generally limited to particular seasons or locations where there is an abundance of snow (or artificial snow) to provide for a smooth skiing experience.

Some attempts have been made to create alternatives to skis, such as skates or other wheeled vehicles, but such vehicles have previously been unsuccessful at reproducing a true skiing experience. For instance, such vehicles have fallen short in terms of ability to withstand the extreme forces of a fast downhill ride on a snowless landscape, or of the performance of jumps and tricks. Additionally, such vehicles are unable to provide the needed shock absorbance and cushioning required to give the rider a smooth and safe experience.

For these reasons, there are significant limitations to the current technology in the roller skiing industry. These limitations remain unaddressed and limit the downhill roller skiing experiences available to consumers. The present invention addresses and overcomes these limitations.

BRIEF SUMMARY OF THE INVENTION

The instant invention is a snowless suspension ski that is capable of providing a true skiing experience on a downhill, snowless terrain. The ski may be configured to withstand the extreme forces of a downhill ride, upon which rough terrain and obstacles such as rocks and branches may be encountered. The ski may also be configured to provide a smooth experience for the rider, as it is configured to absorb the shocks experienced by bouncing, bumping, jarring, and jumping that may occur during a downhill riding experience. The ski may further be configured to provide a minimum amount of clearance between the frame of the ski and the ground, so as to avoid getting caught on obstacles and crashing. The ski may also be configured with additional safety measures, such as mechanisms to prevent the wheels of the ski from shifting underneath the frame, which could lead to a crash.

According to some implementations of the invention, the snowless suspension ski includes a frame, which may include an interior surface, an exterior surface, and a binding attachment feature that is configured to secure a ski binding. The ski also includes a strut mount secured to the interior surface of the frame. The ski also includes a compression triangle having a frame attachment point that is rotatably secured to the interior surface of the frame, and a wheel attachment point that is rotatably secured to a wheel. The ski also includes a shock absorber (a "shock") having a first end that is secured to the strut mount and a second end that is secured to the compression triangle, such that when the compression triangle is rotated in an upward direction, the shock moves toward a compressed configuration. When the compression triangle is rotated in a downward direction, the shock moves toward an extended configuration. According to some implementations, the frame defines a cavity having a lower opening.

According to some implementations, the frame is substantially flat at a first top face and a second top face, and an upper opening is disposed between the first top face and the second top face. The binding attachment feature may include a first binding attachment point disposed on the first top face of the frame and a second binding attachment point disposed on the second top face of the frame. At least one of the first binding attachment point and the second binding attachment point may include a plurality of adjustment features. The frame may further include a first side having a front tapered portion and a rear tapered portion, and a second side having a front tapered portion and a rear tapered portion. The first side and the second side are each attached at the front tapered portion to the first top face of the frame, and attached at the rear tapered portion to the second top face of the frame.

According to some implementations, the compression triangle may include a compression triangle body, a compression triangle window, a top edge, a bottom edge, a back edge, and a sloped front edge. The snowless suspension ski further may include an axillary triangle that is rotatably secured to the exterior of the frame and rotatably secured to the wheel. Similar to the compression triangle, the axillary triangle may have a shape defined by a top edge, a bottom edge, a rear edge, and an angled front edge that tapers to a point. The axillary triangle further may include a first axillary triangle window having a shape that generally resembles the shape of the axillary triangle, and a second axillary triangle window substantially shaped like a right triangle, where the first axillary triangle window is positioned near the angled front edge of the axillary triangle, and the second axillary triangle window is positioned near the rear edge of the axillary triangle. In some embodiments the compression triangle body may comprise an alternative shape such as an oval, a parallelogram, ring or another shape.

According to some implementations of the invention, when the shock is in the extended configuration, the shock prevents the compression triangle from rotating in the downward direction beyond a maximum downward rotation, and when the shock is in the compressed configuration, the shock prevents the compression triangle from rotating in the upward direction beyond a maximum upward rotation. According to some implementations, an angle is defined between an axis of the frame and an axis of the compression triangle. When the shock is in the extended configuration, the angle may be in a certain configuration, such as between 120 and 150 degrees. When the shock is in the compressed configuration, the angle may be in a different configuration, such as between 150 and 180 degrees.

According to some implementations, the snowless suspension ski further may include a detachable disc brake system configured to attach to the wheel. The disc brake system may be operated by a hand brake handle, or any other suitable mechanism for operating a braking system.

According to some implementations of the invention, one general aspect includes a method of manufacturing a snowless suspension ski. The method includes forming a frame, which may include an interior surface, an exterior surface, and a binding attachment feature that is configured to secure a ski binding. The method also includes securing a strut mount to the interior surface of the frame. The method further includes rotatably securing a compression triangle to the interior surface of the frame, and rotatably securing a wheel to the compression triangle. The method also includes securing a shock to the strut mount by a first end of the shock and to the compression triangle by a second end of the shock in such manner that when the compression triangle is rotated in an upward direction, the shock moves toward a compressed configuration, and when the compression triangle is rotated in a downward direction, the shock moves toward an extended configuration.

According to some implementations, the frame may be formed by heating a solid piece of aluminum and pressing it into a frame. The frame may include a first top face, a second top face, a first side have a front tapered portion and a rear tapered portion, and a second side having a front tapered portion and a rear tapered portion. The first side and the second side may be attached at the front tapered portion to the first top face of the frame, and attached at the rear tapered portion to the second top face of the frame. The method further may include forming the compression triangle into a quadrilateral, which may include a compression triangle body, a compression triangle window, a top edge, a bottom edge, a back edge, and a sloped front edge.

According to some implementations, the method further may include rotatably attaching an axillary triangle to the outside surface of the frame and rotatably attaching the axillary triangle to the wheel. The method may include assembling the ski in such a manner that, when the shock is in the extended configuration, the shock prevents the compression triangle from rotating in the downward direction beyond a maximum downward rotation, and when the shock is in the compressed configuration, the shock prevents the compression triangle from rotating in the upward direction beyond a maximum upward rotation.

According to some implementations, upon assembling the ski, an angle is defined between an axis of the frame and an axis of the compression triangle, where when the shock is in the extended configuration, the angle is in a particular configuration (such as between 120 and 150 degrees), and where when the shock is in the compressed configuration, the angle is in a different configuration (such as between 150 and 180 degrees). The method further may include attaching a disc brake system operated by a hand brake handle to the wheel.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take other forms and shapes, hence the following disclosure is intended to be illustrative and not limiting.

According to some embodiments of the instant invention, the invention is a snowless suspension ski that is capable of providing a true skiing experience on a downhill, snowless terrain. The ski has many advantages over skis found in the prior art. For instance, the ski may be configured to withstand the extreme forces of a downhill ride, upon which rough terrain and obstacles such as rocks and branches may be encountered. The ski may also be configured to provide a smooth experience for the rider, as it is configured to absorb the shocks experienced by bouncing, bumping, jarring, and jumping that may occur during a downhill riding experience. The ski may further be configured to provide a minimum amount of clearance between the frame of the ski and the ground, so as to avoid getting caught on obstacles and crashing. The ski may also be configured with additional safety measures, such as a mechanism to prevent the wheels of the ski from shifting underneath the frame, which could lead to a crash.

Figure 1:
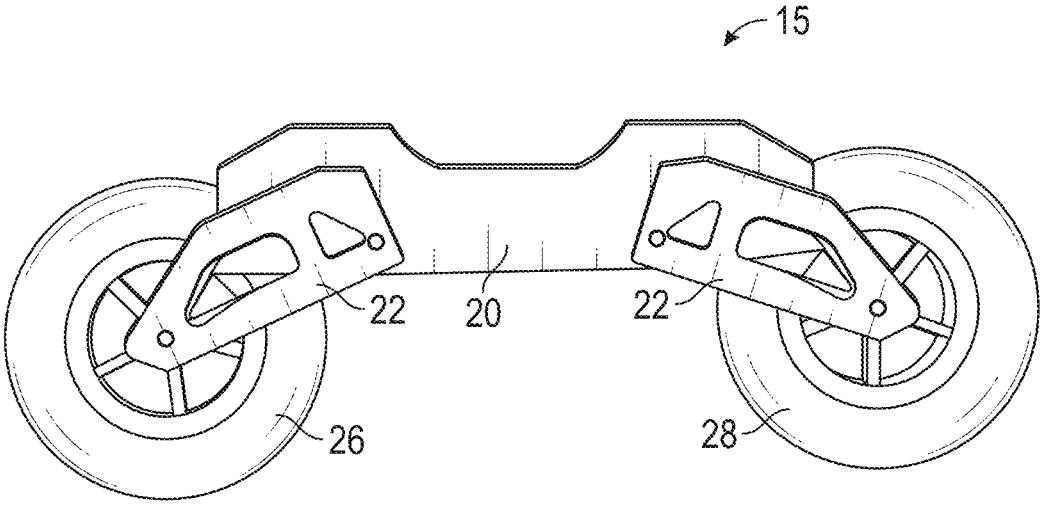
FIG. 1 shows a side view of the invention, in accordance with a representative embodiment of the present invention.

Referring to FIG. 1, according to some embodiments of the invention, the invention is a snowless suspension ski 15. The ski has a frame 20 that is attached to a front wheel 26 and a rear wheel 28 by connectors. For example, each of the connectors may be an axillary triangle 22. The axillary triangles are rotatably attached to an exterior surface of the frame, such that they may freely revolve around the point of attachment. The axillary triangles are also rotatably attached to the wheels, allowing the wheels to freely spin while remaining attached to the frame.

According to some embodiments, the wheels 26, 28 may be removable or interchangeable, such that wheels with different tire sizes may be used. For example, the ski may include 8-inch tires, 9-inch tires, or tires of any other suitable size. Additionally, in some embodiments, pneumatic tires are used to help absorb impacts and provide a smoother riding experience. Moreover, one or both of the wheels (but often the rear wheel in particular) may be equipped with a disc brake system 29 configured to withstand the extreme temperatures and pressures of a snowless ski ride. The disc brake system may include a hand brake, or any other suitable method for operating the disc brake.

Figure 2:
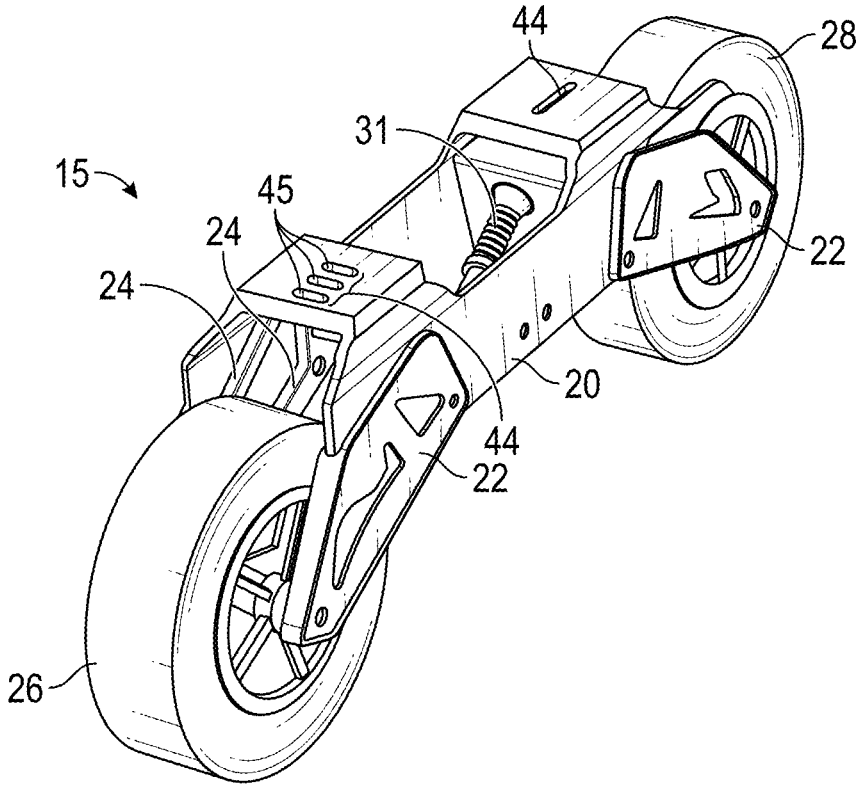
FIG. 2 shows a top perspective view of the invention, in accordance with a representative embodiment of the present invention.

Referring now to FIG. 2, according to some embodiments of the invention, the wheels may be attached to the frame by compression triangles 24 in addition to or instead of axillary triangles 22. Each compression triangle is rotatably attached at one point to a wheel and rotatably attached at another point to an interior surface of the frame. Furthermore, each compression triangle is attached at yet another point to a shock absorber (a "shock"), whether that be a front shock (not visible in FIG. 2) or a rear shock 31. Thus, the ski 15 may include a frame 20 attached to a front wheel 26 by two compression triangles, with one compression triangle on either side of the wheel. The frame may further be attached to a rear wheel by two compression triangles, with one compression triangle on either side of the wheel. Additionally, the ski may include four axillary triangles, each attached to the exterior surface of the frame and to one side of one wheel. Accordingly, the axillary triangles may each align, run parallel with, and (from a side view) obscure a corresponding compression triangle. The compression triangles may increase the aesthetic appearance of the ski, make the ski more durable, and assist in preventing the wheels from moving in a direction perpendicular to the frame of the ski.

Figure 3:
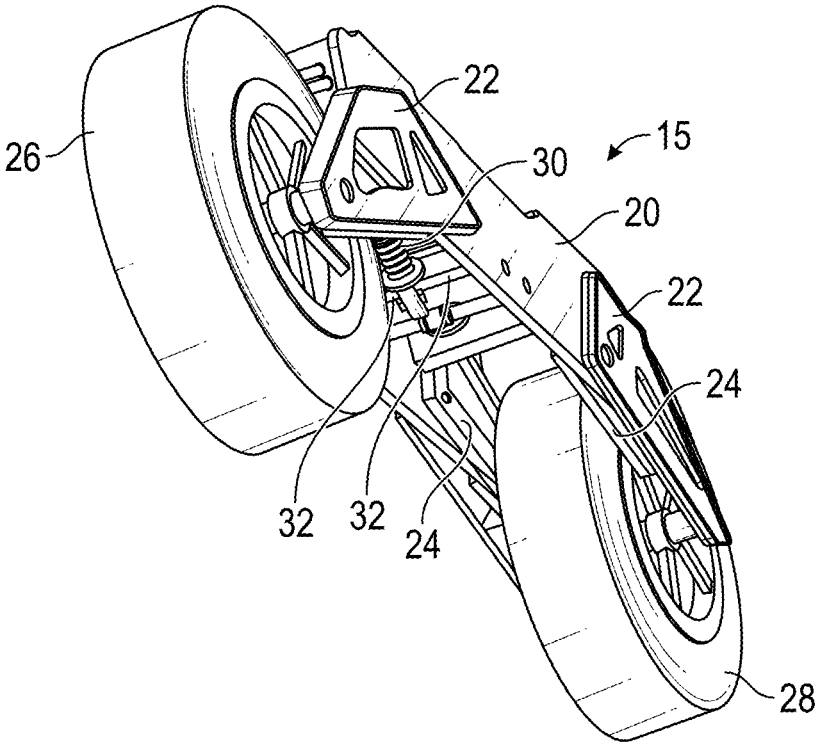
FIG. 3 shows a bottom perspective view of the invention, in accordance with a representative embodiment of the present invention.

With reference now to FIG. 3, according to some embodiments of the invention, the ski includes at least one strut mount 32. Each shock, whether that be a front shock 30 or a rear shock (not visible in FIG. 3), is attached at one end to a strut mount. For example, the shocks may be attached to the same strut mount, or they may each be attached to separate strut mounts. In some embodiments, there is a rear strut mount to which the rear shock attaches, and a front strut mount to which the front shock attaches. In any case, each strut mount is attached to the interior surface of the frame. As an example, each strut mount may be anchored to both sides of the frame, thereby spanning a cavity defined by the frame. The other end of each shock (the end that is not attached to a strut mount) is attached to a compression triangle. For example, the rear shock may be attached to a rear strut mount at one end and to a first rear compression triangle and a second rear compression triangle at the other end. Similarly, the front shock may be attached to a front strut mount at one end and to a first front compression triangle and a second front compression triangle at the other end.

Figure 4A:
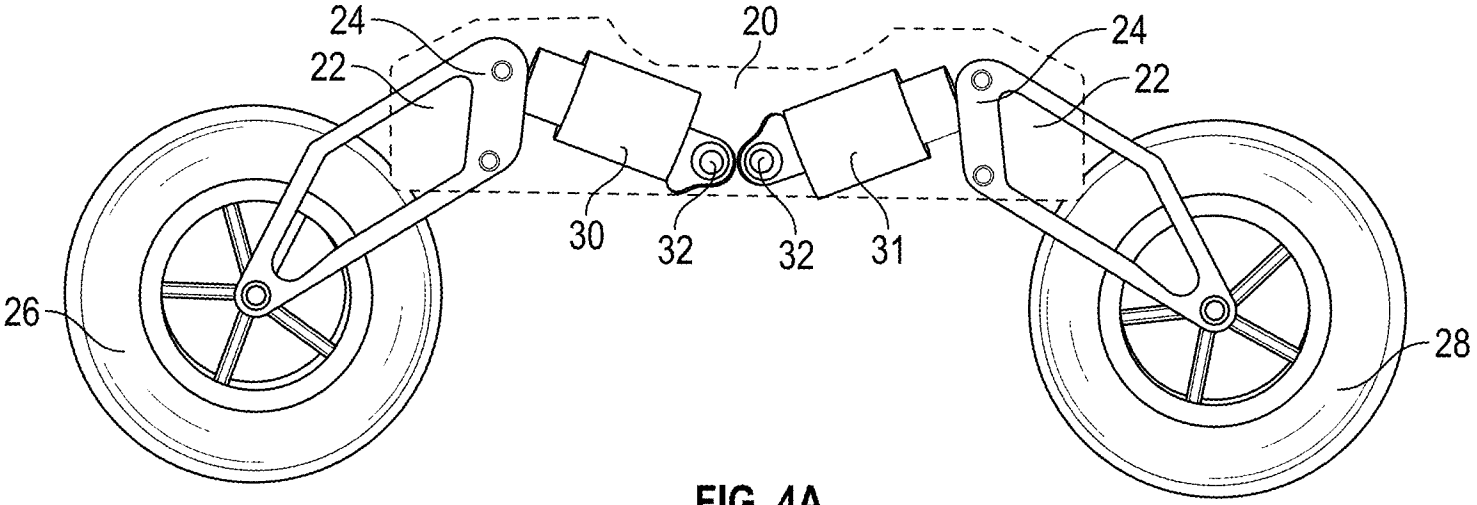
FIGS. 4A and 4B show a side, cut-away view of the invention in multiple configurations, in accordance with a representative embodiment of the present invention.
Figure 4B:
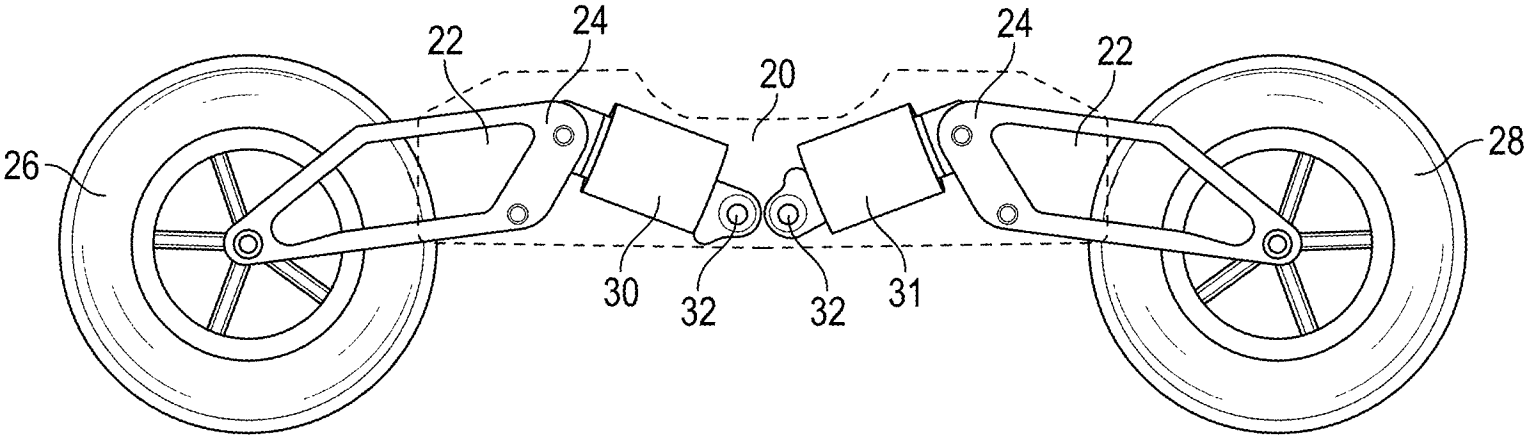

As illustrated by FIG. 4A and FIG. 4B, in some embodiments, the positioning of the various components of the snowless suspension ski give rise to many of its unique attributes. In this regard, FIG. 4A shows the ski in a first configuration (also called an extended configuration). FIG. 4B shows the ski in a second configuration (also called a compressed configuration). In these Figures, it can be clearly seen that each wheel (the front wheel 26 and the back wheel 28) is attached to the frame 20 by a compression triangle 24. Each compression triangle is rotatably attached to a wheel and rotatably attached to the frame. Moreover, each compression triangle is attached to a shock (whether that be a front shock 30 or a rear shock 31), and each shock is attached to a strut mount 32. According to some embodiments, the shocks are customizable or replaceable, allowing for a user to install stronger or weaker shocks for a custom riding experience.

In some embodiments, the shocks 30, 31 are configured to provide a decompressive force. This decompressive force pushes on the compression triangles 24, causing them to rotate in a downward direction about the rotation point created by the attachment of the compression triangles to the frame 20. This rotation is in a generally downward direction, thereby pushing the wheels 26, 28 in a downward direction and congruently lifting the frame away from the ground. Accordingly, the decompressive force created by the shocks biases the ski toward the extended configuration (as shown in FIG. 4A). However, when a downward force is exerted on the frame (such as from a user's weight being applied to the top of the frame, whether that be from stepping onto the ski, from up-and-down motion created by the terrain while the ski is in use, or from landing after performing a jump), this causes the compression triangles to rotate in a generally upward direction, thereby causing the shocks to compress (either partially or completely). Such compression causes the ski to move toward the compressed configuration (as shown in FIG. 4B), and this allows the ski to absorb the shock created by rough terrain, high speeds, and other conditions present in downhill skiing.

In some embodiments, when the shocks 30, 31 are in the extended configuration, the shocks prevent the corresponding compression triangles from rotating in the downward direction beyond a maximum downward rotation (e.g., because the shocks are fully extended), and when the shocks are in the compressed configuration, the shocks prevent the corresponding compression triangles from rotating in the upward direction beyond a maximum upward rotation (e.g., because the shocks are fully compressed). Additionally, according to some embodiments, an angle is defined between an axis of the frame and an axis of a compression triangle. When the shock attached to such compression triangle is in the extended configuration, the angle may have a first angle measurement, and when the shock is in the compressed configuration, the angle may have a second measurement. In some embodiments, the first measurement is approximately 135 degrees. For example, the angle may be between 130 and 140 degrees, between 120 and 150 degrees, or between 110 and 160 degrees. In some embodiments, the second measurement is approximately 180 degrees or slightly less than 180 degrees. For example, the angle may be between 170 and 180 degrees, 160 and 180 degrees, or 150 and 180 degrees. There are also embodiments in which the second angle is greater than 180 degrees (for example the angle could be between 150 and 200 degrees), but in some embodiments the maximum upward rotation of the compression triangles is reached before the angle can exceed 180 degrees, thereby preventing the frame of the ski from dropping below a midpoint of one or both wheels. Accordingly, in such embodiments, there is a minimum clearance between the bottom of the frame and the ground, and such minimum clearance is at least as large as the radius of the tires.

Figure 5:
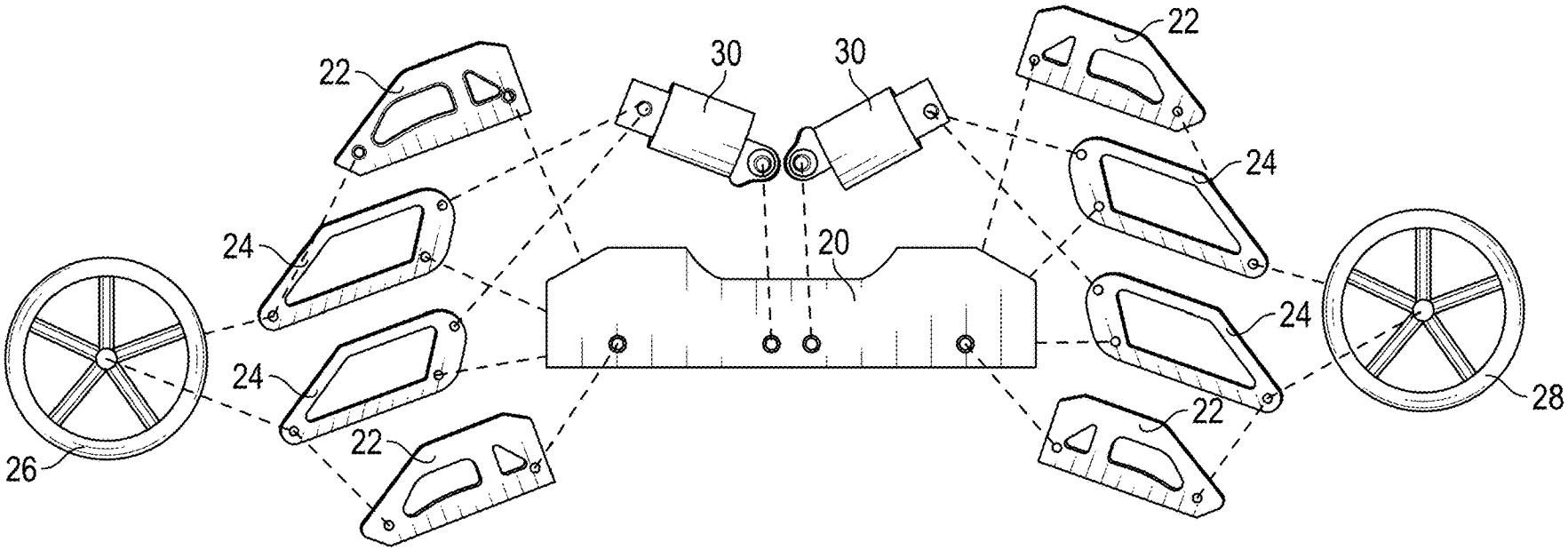
FIG. 5 shows an exploded view of components of the inventions, in accordance with a representative embodiment of components of the present invention.

Referring now to FIG. 5, according to some embodiments of the invention, the ski includes four compression triangles 24, each rotatably attached to the interior surface of a frame 20, with one attached near the front of the first side, one attached near the rear of the first side, one attached near the front of the second side, and one attached near the rear of the second side. The ski further includes four axillary triangles 22 rotatably attached to the exterior surface of the frame, each placed parallel to a corresponding compression triangle. The ski further includes a front wheel 26 and a rear wheel 28, which are each disposed between and attached to a pair of compression triangles and a pair of axillary triangles. Furthermore, the ski includes a front shock 30 and a rear shock 31, and each shock is anchored to a strut mount 20 at one end and attached to a pair of compression triangles at the other end.

Figure 6A:
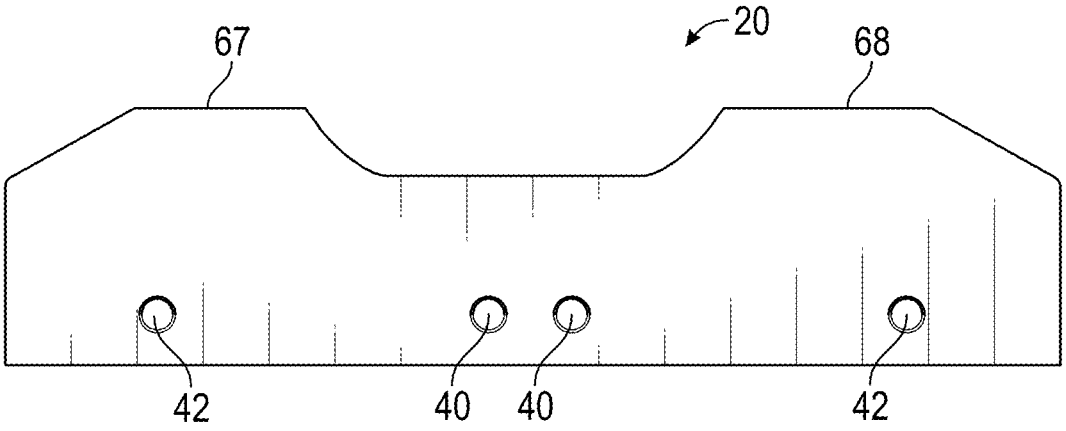
FIG. 6A shows a side view of a frame, in accordance with a representative embodiment of a component of the present invention.
Figure 6B:
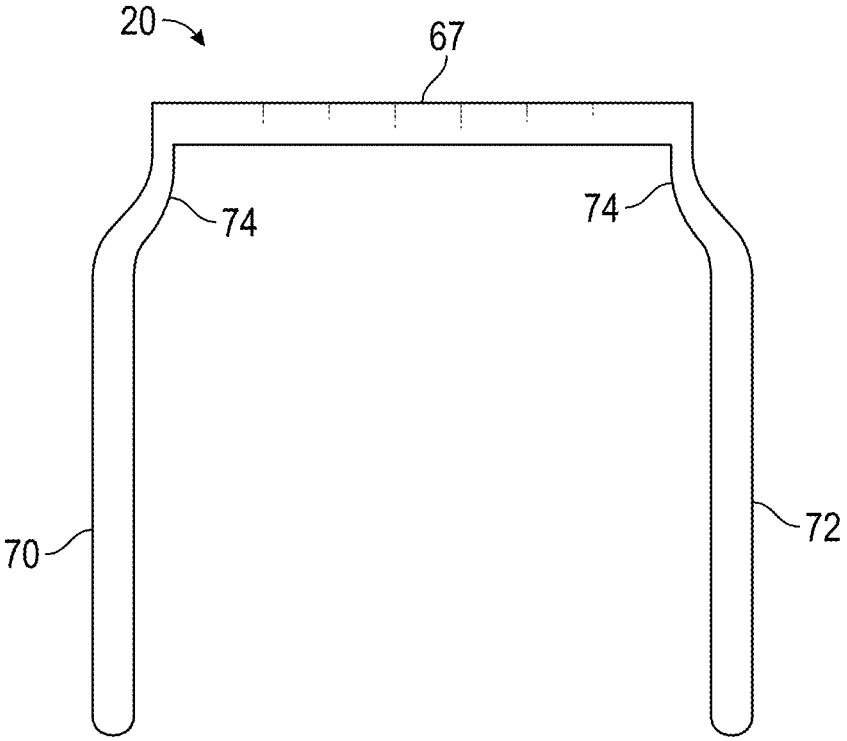
FIG. 6B shows a frontal view of a frame, in accordance with a representative embodiment of a component of the present invention.
Figure 6C:
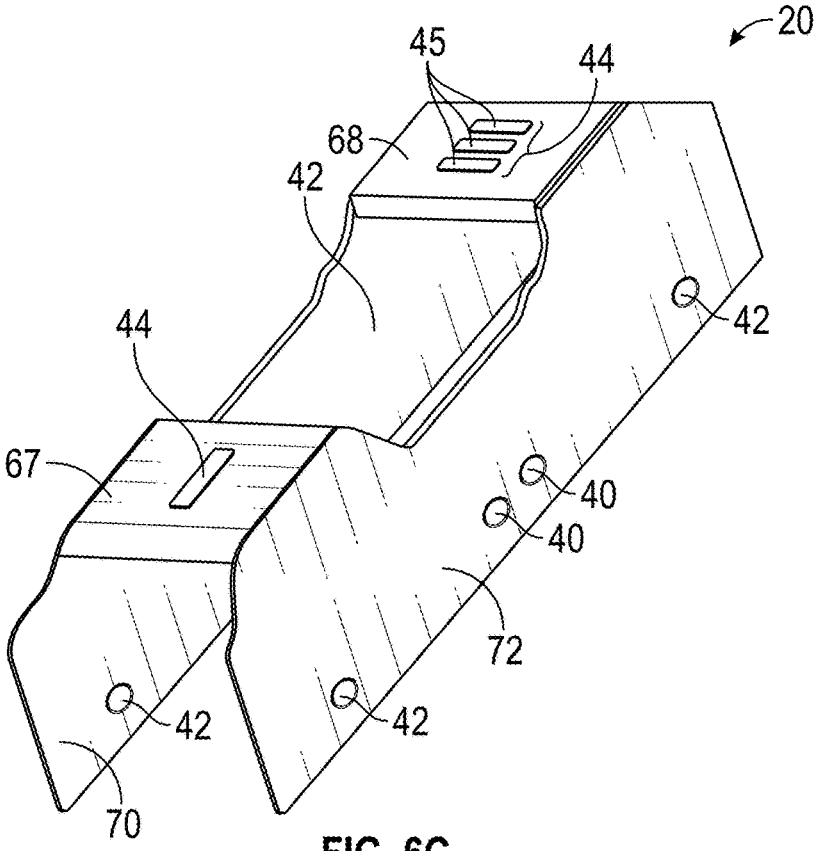
FIG. 6C shows a top perspective view of a frame, in accordance with a representative embodiment of a component of the present invention.

With reference to FIGS. 6A-6C, according to some embodiments, the frame as discussed in connection with any of the embodiments of the invention can include additional features. For example, in some embodiments, the frame is created from a single piece of material (such as aluminum or another metal). This allows for fewer bolts, screws, or other attachment pieces to be used, which in turn increases the durability and structural integrity of the ski, making it more suitable for downhill and other use.

According to some embodiments, the frame has a first side 70, a second side 72, a first top face 67, and a second top face 68. The frame may be tapered between the sides and the top faces (such as at the tapered portion 74 shown in FIG. 6B), thus resulting in the first top face and the second top face each having a width that is less than the width of the frame. The first top face and the second top face may also be the highest portions of the frame, standing out from the remainder of the frame. The frame further includes a strut mount attachment point 40 (or multiple strut mount attachment points) and a triangle attachment point 42 (or multiple triangle attachment points). The strut mount attachment point(s) and triangle attachment point(s) may be holes, or they may be any other feature suitable for creating fixed or rotatable attachments between components of the invention. Moreover, according to some embodiments of the invention, the frame defines a cavity having a lower opening. The cavity houses the shocks 30, 31, the strut mount 32, and the compression triangles 22. The lower opening is configured to allow portions of the compression triangle to move below the bottom of the frame, so the compression triangle can freely rotate without catching on portions of the frame. Furthermore, an upper opening may be defined between the first top face and the second top face, decreasing the weight of the ski and allowing access to the shocks for maintenance or customization purposes.

According to some embodiments, the ski includes a binding attachment feature 44. The binding attachment feature may include a binding attachment point at either the first top face 67 of the frame 20, the second top face 68 of the frame, or each of the top faces of the frame. Each binding attachment point of the binding attachment feature may include a groove, a hole, a slit, a slot, a clip, or any other feature that is configured to secure a ski binding. The binding attachment feature may further include a plurality of adjustment features 45 configured to allow the ski binding to be attached in a variety of manners (such as to accommodate for different sizes or types of ski bindings). In a particular embodiment, the binding attachment feature includes a slot on the first face of the frame running parallel to the frame, and the binding attachment feature includes a plurality of adjustment features on the second face of the frame, where each of the adjustment features is a slot running perpendicular to the frame.

Figure 7:
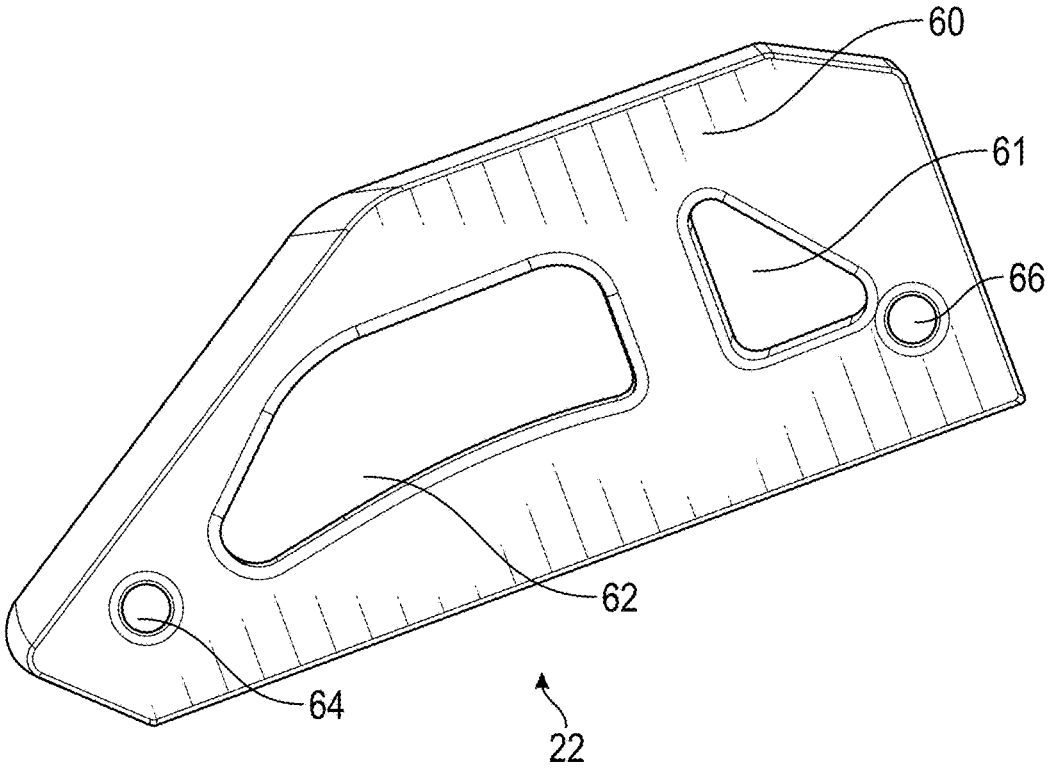
FIG. 7 shows a side view of an axillary triangle, in accordance with a representative embodiment of a component of the present invention.

Referring now to FIG. 7, the axillary triangles discussed with any embodiment of the invention can include additional features. For example, according to some embodiments, an axillary triangle 22 includes an axillary triangle body 60 that defines a first axillary triangle window 61 and a second axillary triangle window 62. It further includes a wheel attachment point 64 and a frame attachment point 66. The axillary triangle may have a bottom side, a back side (near the frame attachment point), a top side (which may include a portion that gently slopes toward the back side), and a front side. The front side may be sloped and/or taper to a point (such as the point near the wheel attachment point as shown in FIG. 7). The first axillary triangle window may take the shape of a right triangle, with a 90 degree angle defined between a side that faces downward and a side that faces toward the front of the axillary triangle, with the hypotenuse facing toward the intersection of the back side and the top side of the axillary triangle. The second axillary triangle window may have a shape that resembles the general quadrilateral shape of the axillary triangle having the same orientation as the axillary triangle. The overall design of the axillary triangle can maximize the strength and durability of the axillary triangle while simultaneously ensuring that it is lightweight and effective.

Figure 8A:
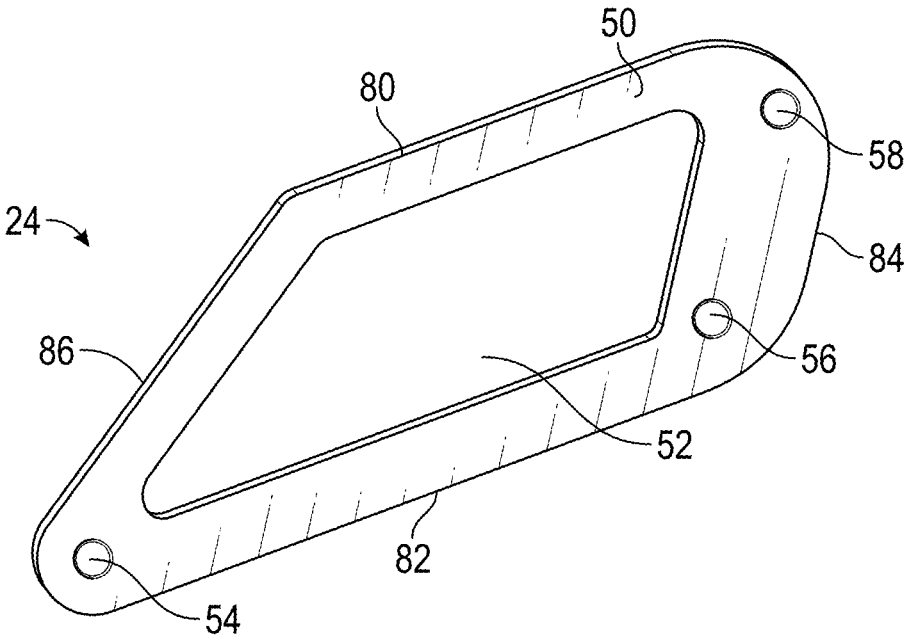
FIGS. 8A and 8B show side views of various designs for a compression triangle, in accordance with representative embodiments of a component of the present invention.
Figure 8B:
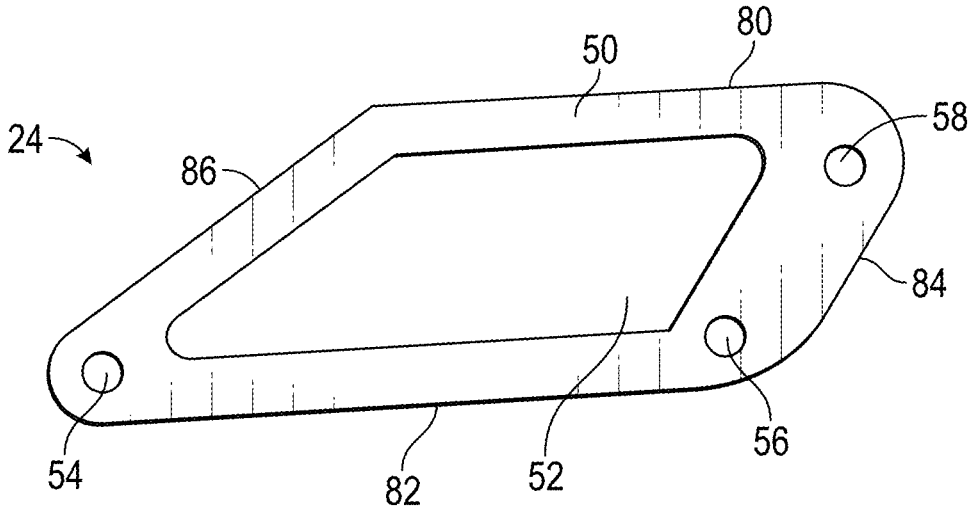

With reference to FIGS. 8A and 8B, the compression triangles discussed in accordance with any embodiment of the invention may include additional features. For instance, according to some embodiments, a compression triangle 24 includes a compression triangle body 50 and a compression tringle window 52. The compression triangle window may have a shape that generally resembles the overall shape of the compression triangle. The compression triangle further incudes a wheel attachment point 54, a frame attachment point 56, and a shock attachment point 58. Moreover, the compression triangle has a generally quadrilateral shape, with a top edge 80, a bottom edge 82, a back edge 84, and a sloped front edge 86. The intersection of the front edge and the bottom edge may form an angle that is approximately 45 degrees (such as between 40 and 50 degrees, or between 30 and 60 degrees). The compression triangle may vary in shape. For instance, the intersection of the top edge, the back edge, and the bottom edge may be approximately semicircular (as shown in FIG. 8A), or the angles may be somewhat sharper (as illustrated by FIG. 8B). The difference in shape between various compression triangles may affect the maximum upward rotation and maximum downward rotation discussed above, thereby changing the minimum clearance between the frame and the ground and/or the angles between the frame and the compression triangles, leading to a varied riding experience. In some embodiments, the compression triangles are replaceable and customizable, allowing a rider to adjust the shock-absorbent properties of the ski based on the rider's preference. According to some embodiments, the wheel attachment point is placed near a front side of the compression triangle, near the intersection of the front edge and the bottom edge. The frame attachment point is placed near a back side of the compression triangle, near the intersection of the back edge and the bottom edge. The shock attachment point is placed near the back side, but above the frame attachment point, near the intersection of the back edge and the top edge. This configuration allows for the interaction of the compression of a shock and the rotation of the compression triangle to have the desired results.

With reference now to all of FIGS. 1-8B, according to some embodiments, the invention is a method for manufacturing a snowless suspension ski, such as the one discussed in the foregoing embodiments. In some embodiments, the method includes forming a frame 20, which may include an interior surface, an exterior surface, and a binding attachment feature 44 that is configured to secure a ski binding. The method also includes securing a strut mount 32 to the interior surface of the frame. The method further includes rotatably securing a compression triangle 24 to the interior surface of the frame, and rotatably securing a wheel (such as a front wheel 26 or a rear wheel 28) to the compression triangle. The method also includes securing a shock (such as a front shock 30 or a rear shock 31) to the strut mount by a first end of the shock and to the compression triangle by a second end of the shock in such manner that when the compression triangle is rotated in an upward direction, the shock moves toward a compressed configuration, and when the compression triangle is rotated in a downward direction, the shock moves toward an extended configuration.

In some embodiments, the method further includes forming the frame 20 by heating a solid piece of aluminum and pressing it into the desired frame shape. The frame shape may include a first top face 67, a second top face 68, a first side 70 having a front tapered portion 74 and a rear tapered portion 74, and a second side having a front tapered portion 74 and a rear tapered portion 74. The first side and the second side may be attached at the front tapered portion to the first top face of the frame, and attached at the rear tapered portion to the second top face of the frame. The method further may include forming the compression triangle into a quadrilateral, which may include a compression triangle body 50, a compression triangle window 52, a top edge 80, a bottom edge 82, a back edge 84, and a sloped front edge 86.

According to some embodiments, the method further may include rotatably attaching an axillary triangle 22 to the outside surface of the frame 20 and rotatably attaching the axillary triangle to the wheel 26, 28. The method may include assembling the ski in such a manner that, when the shock 30, 31 is in the extended configuration, the shock prevents the compression triangle 24 from rotating in the downward direction beyond a maximum downward rotation, and when the shock is in the compressed configuration, the shock prevents the compression triangle from rotating in the upward direction beyond a maximum upward rotation.

According to some embodiments, upon assembling the ski, an angle is defined between an axis of the frame 20 and an axis of the compression triangle 24, where when the shock 30, 31 is in the extended configuration, the angle is in a particular configuration (such as between 120 and 150 degrees), and where when the shock is in the compressed configuration, the angle is in a different configuration (such as between 150 and 180 degrees). The method further may include attaching a disc brake system operated by a hand brake handle 33 to the wheel.

According to some embodiments, the method further includes assembling any of the elements of the ski as discussed in any of the embodiments above, with any of the features discussed in such embodiments, and connecting the elements together as generally illustrated by FIG. 5.

Figure 9:
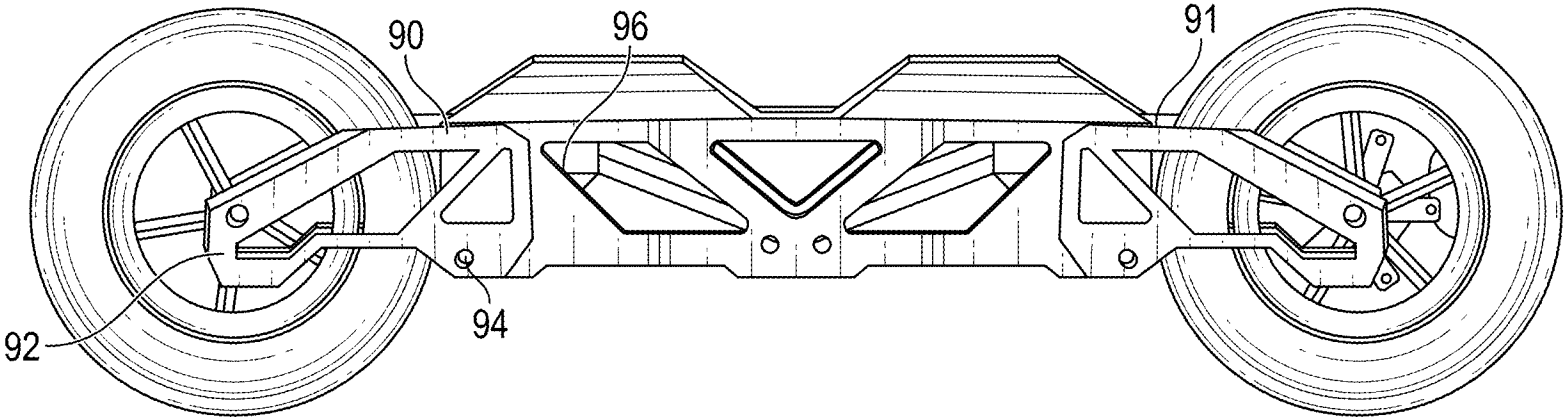
FIG. 9 shows an alternative embodiment where the compression triangle and auxiliary triangle form an unitary structure.
Figure 10A:
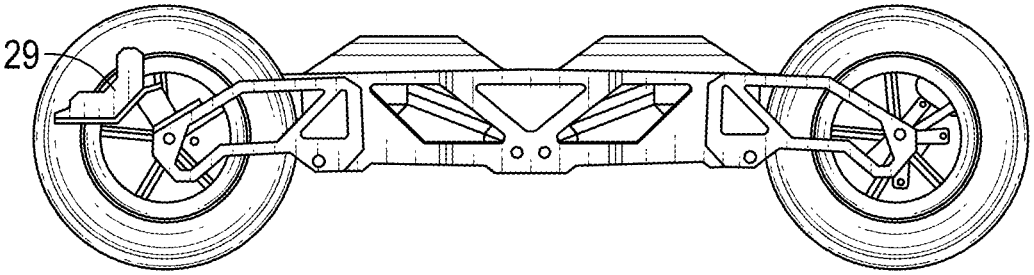
FIG. 10A shows a side view of the invention.
Figure 10B:
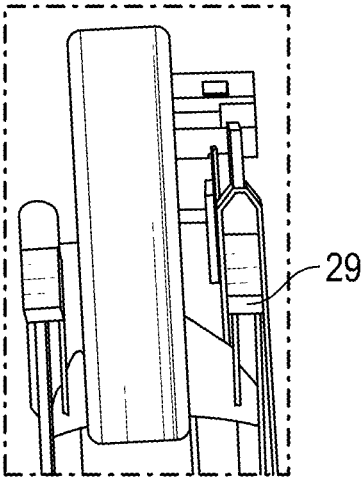
FIG. 10B shows a front view of the invention.
Figure 10C:
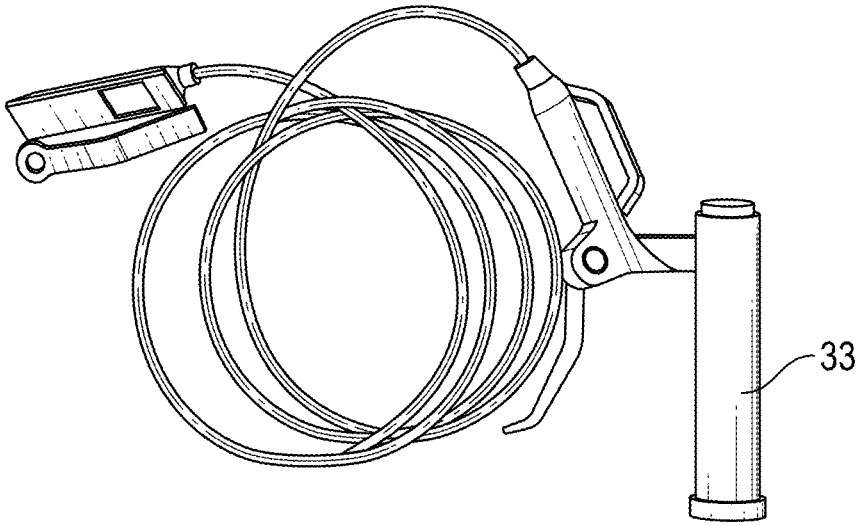
FIG. 10C shows a brake handle as disclosed in the invention.

Referring now to FIG. 9, according to some embodiments, the compression triangle 24 and the auxiliary triangle 22 comprise an integrated unitary structure front piece 88 and rear piece 89. In some embodiments the unitary structure 88, 89 further comprises a slot 90 configured to receive the frame 20. As the snowless suspension ski 15 moves across uneven ground the front and rear wheel independently articulate and the front and rear slots 90, 91 on the front and rear unitary structure 88, 89 move within the slot 90 while the frame 20 remains comparatively still, allowing the rider to maintain control while riding through rough terrain. In some embodiments the snowless suspension ski 15 is an assembly wherein the unitary structure 88, 89 comprises a plurality of bolt holes 92, 94, 96 whereby the bolt holes are coupled to the frame 20. In some embodiments the frame selectively couples to the unitary structure 88, 89. In some embodiments the unitary structure 88, 89 selectively couples to a tire 26, 28. In some embodiments suspension 30, 31 are selectively coupled to the frame 20 and the unitary structure 88, 89. Integrating the compression triangle and the auxiliary triangle into a single unitary structures 88, 89 improves torsional rigidity and performance of the snowless suspension ski 15 as well as simplifies the aesthetic.

The person of ordinary skill in the art will recognize that many of the embodiments discussed above may be used together in unique and useful combinations, creating an overall product that is not anticipated by the prior art. Thus, the invention is not limited to any particular embodiment discussed herein, but the features discussed above may be incorporated into various embodiments of the invention. Accordingly, the scope of the invention should be determined not by any particular embodiment described herein, but rather with reference to the appended claims.

What is claimed is:

1. A snowless suspension ski, comprising:

a frame comprising an interior surface, an exterior surface, and a binding attachment feature that is configured to secure a ski binding;

a strut mount secured to the interior surface of the frame;

a compression triangle a compression triangle body, a compression triangle window, a top edge, a bottom edge, a back edge, and a sloped front edge and a frame attachment point that is rotatably secured to the interior surface of the frame, and a wheel attachment point that is rotatably secured to a wheel wherein the compression triangle further comprises a compression triangle body, a compression triangle window, a top edge, a bottom edge, a back edge, and a sloped front edge; and a shock having a first end that is secured to the strut mount and a second end that is secured to the compression triangle such that when the compression triangle is rotated in an upward direction the shock moves toward a compressed configuration, and when the compression triangle is rotated in a downward direction the shock moves toward an extended configuration.

2. The snowless suspension ski of claim 1, wherein the frame defines a cavity having a lower opening, wherein the frame is substantially flat at a first top face and a second top face, and wherein an upper opening is disposed between the first top face and the second top face.

3. The snowless suspension ski of claim 2, wherein the binding attachment feature comprises a first binding attachment point disposed on the first top face of the frame and a second binding attachment point disposed on the second top face of the frame.

4. The snowless suspension ski of claim 3, wherein at least one of the first binding attachment point and the second binding attachment point comprises a plurality of adjustment features.

5. The snowless suspension ski of claim 2, wherein the frame further comprises:

a first side have a front tapered portion and a rear tapered portion; and a second side having a front tapered portion and a rear tapered portion;

wherein each of the first side and the second side is attached at the front tapered portion to the first top face of the frame, and attached at the rear tapered portion to the second top face of the frame.

6. The snowless suspension ski of claim 1, wherein the snowless suspension ski further comprises an axillary triangle that is rotatably secured to the exterior of the frame and rotatably secured to the wheel.

7. The snowless suspension ski of claim 6, wherein the axillary triangle has a shape defined by a top edge, a bottom edge, a rear edge, and an angled front edge that tapers to a point.

8. The snowless suspension ski of claim 7, wherein the axillary triangle further comprises a first axillary triangle window having a shape that generally resembles the shape of the axillary triangle, and a second axillary triangle window substantially shaped like a right triangle, wherein the first axillary triangle window is positioned near the angled front edge of the axillary triangle, and the second axillary triangle window is positioned near the rear edge of the axillary triangle.

9. The snowless suspension ski of claim 1, wherein when the shock is in the extended configuration, the shock prevents the compression triangle from rotating in the downward direction beyond a maximum downward rotation, and when the shock is in the compressed configuration, the shock prevents the compression triangle from rotating in the upward direction beyond a maximum upward rotation.

10. The snowless suspension ski of claim 9, wherein an angle is defined between an axis of the frame and an axis of the compression triangle, wherein when the shock is in the extended configuration, the angle is between 120 and 150 degrees, and wherein when the shock is in the compressed configuration, the angle is between 150 and 180 degrees.

11. The snowless suspension ski of claim 1, wherein the snowless suspension ski further comprises a detachable disc brake system configured to attach to the wheel.

12. The snowless suspension ski of claim 11, wherein the disc brake system is operated by a hand brake handle.

13. A snowless suspension ski, comprising:

a frame comprising an interior surface, an exterior surface, and a binding attachment feature;

a first compression triangle comprising a compression triangle body, a compression triangle window, a top edge, a bottom edge, a back edge, and a sloped front edge and a slot wherein the slot is configured to selectively receive the frame;

a second compression triangle comprising a slot wherein the slot is configured to selectively receive the frame;

a first suspension shock selectively coupled at a first end to the frame and at a second end to the first articulating triangle;

a second suspension shock selectively coupled at a first end to the frame and at a second end to the second articulating triangle; and a first tire selectively coupled to a distal end of the first triangle and a second tire selectively coupled to a distal end of the second triangle.

14. A method of manufacturing a snowless suspension ski, wherein the method comprises:

forming a frame comprising an interior surface, an exterior surface, and a binding attachment feature that is configured to secure a ski binding;

securing a strut mount to the interior surface of the frame;

rotatably securing a compression triangle to the interior surface of the frame and forming the compression triangle into a quadrilateral comprising a compression triangle body, a compression triangle window, a top edge, a bottom edge, a back edge, and a sloped front edge;

rotatably securing a wheel to the compression triangle; and securing a shock to the strut mount by a first end of the shock and to the compression triangle by a second end of the shock in such manner that when the compression triangle is rotated in an upward direction the shock moves toward a compressed configuration, and when the compression triangle is rotated in a downward direction the shock moves toward an extended configuration.

15. The method of claim 14 wherein the frame is formed by heating a solid piece of aluminum and pressing it into a frame comprising: a first top face; a second top face; a first side have a front tapered portion and a rear tapered portion; and a second side having a front tapered portion and a rear tapered portion; wherein each of the first side and the second side is attached at the front tapered portion to the first top face of the frame, and attached at the rear tapered portion to the second top face of the frame.

16. The method of claim 14, wherein the method further comprises rotatably attaching an axillary triangle to the outside surface of the frame and rotatably attaching the axillary triangle to the wheel.

17. The snowless method of claim 14, wherein when the shock is in the extended configuration, the shock prevents the compression triangle from rotating in the downward direction beyond a maximum downward rotation, and when the shock is in the compressed configuration, the shock prevents the compression triangle from rotating in the upward direction beyond a maximum upward rotation.

18. The method of claim 16, wherein an angle is defined between an axis of the frame and an axis of the compression triangle, wherein when the shock is in the extended configuration, the angle is between 120 and 150 degrees, and wherein when the shock is in the compressed configuration, the angle is between 150 and 180 degrees.

* * * * *